US005250404A

United States Patent [19]

Sakakibara

[11] Patent Number: 5,250,404

[45] Date of Patent: Oct. 5, 1993

[54] SILVER HALIDE PHOTOGRAPHIC MATERIAL HAVING MAGNETIC RECORDING ELEMENT

[75] Inventor: Yoshio Sakakibara, Kanagawa, Japan

[73] Assignee: Fuji Photo Film Co., Ltd., Kanagawa, Japan

[21] Appl. No.: 758,151

[22] Filed: Sep. 12, 1991

[30] Foreign Application Priority Data

Sep. 14, 1990 [JP] Japan ..... 2-245792
Sep. 6, 1991 [JP] Japan ..... 3-227097

[51] Int. Cl.[5] ..... G03C 1/76

[52] U.S. Cl. ..... 430/523; 430/140; 430/531; 430/533; 430/935; 428/694 SC; 264/171; 264/108; 427/128; 252/62.54

[58] Field of Search ..... 430/140, 523, 531, 533, 430/935; 428/694; 264/171, 108; 427/128; 252/62.54

[56] References Cited

U.S. PATENT DOCUMENTS 3,782,947 1/1974 Krall ..... 430/132
3,920,862 11/1975 Damschroder et al. ..... 430/140
4,076,895 2/1978 Theno ..... 428/516
4,279,945 7/1981 Audran et al. ..... 430/140
4,302,523 11/1981 Audran et al. ..... 430/140
4,324,816 4/1982 Landis et al. ..... 430/140
4,569,863 2/1986 Koepke et al. ..... 427/402
4,572,849 2/1986 Koepke et al. ..... 427/402
5,147,768 9/1992 Sakakibara ..... 430/39

FOREIGN PATENT DOCUMENTS 0094724 5/1986 Japan .

OTHER PUBLICATIONS

Research Disclosure, vol. 308, Item 308119, Section XV, pp. 1007-1008, Dec. 1989, Anonymous.

*Primary Examiner*—Charles L. Bowers, Jr.
*Assistant Examiner*—Thomas R. Neville
*Attorney, Agent, or Firm*—Sughrue, Mion, Zinn, Macpeak & Seas

[57] ABSTRACT

A silver halide photographic material is disclosed, comprising a transparent support containing a magnetic recording material, wherein the support is formed by co-flow-extending a dope containing the magnetic recording material and a dope not containing the magnetic recording material.

10 Claims, 2 Drawing Sheets

SILVER HALIDE PHOTOGRAPHIC MATERIAL HAVING MAGNETIC RECORDING ELEMENT

FIELD OF THE INVENTION

The present invention relates to a silver halide photographic material including a magnetic recording layer exhibiting excellent magnetic recording and reproducing characteristics.

BACKGROUND OF THE INVENTION

A silver halide photographic material (hereinafter referred to merely as a "light-sensitive material") is known that contains both a photograph section and one or more narrow belt-like sections constituting a magnetic recording medium for the purpose of recording information other than images either at the time of photographing or at the time of printing. However, the belt-like sections produce various disadvantages; for example, curves with irregularities are produced by the presence of the belt-like section, and air is trapped in a clearance between the belt-like sections, exerting adverse influences on photographic properties.

In order to overcome the above problems, U.S. Pat. Nos. 3,782,947, and 4,279,945, for example, disclose that a transparent magnetic recording layer can be provided in the photograph section. According to a signal input and output system disclosed in WO 90/4205 and WO 90/04212, it is possible to input photographing conditions such as date of photographing, weather, and reducing or enlarging ratio, and also conditions at the time of development or printing, such as number of reprinted sheets, portion to be zoomed, and message, and further to output the above information in a video equipment such as a TV set and a video set.

However, when the magnetic recording layer is provided in the photographic section, it is necessary to minimize the coating content of the magnetic recording material per unit area of the light sensitive material in order to inhibit to the greatest extent possible the adverse effect of a decrease of photographic sensitivity due to inadvertent absorption by the magnetic recording material. However, such a decrease of the content of the magnetic recording material causes the problem that magnetic output characteristics are insatisfactory. Thus, it has been desired in the field to develop a method whereby the maximum magnetic characteristics are exhibited using a magnetic recording material which is decreased in content as much as possible.

SUMMARY OF THE INVENTION

An object of the present invention is to provide a light-sensitive material having a magnetic recording layer which causes less adverse influences on the optical photographic properties of the light-sensitive material which also exhibits excellent magnetic characteristics.

The object of the present invention has been achieved by a light-sensitive material containing a magnetic recording material in a transparent support, the support being formed by co-flow-extending a dope solution containing the magnetic recording material and a dope solution not containing the magnetic recording material.

DETAILED DESCRIPTION OF THE INVENTION

Figure 1:
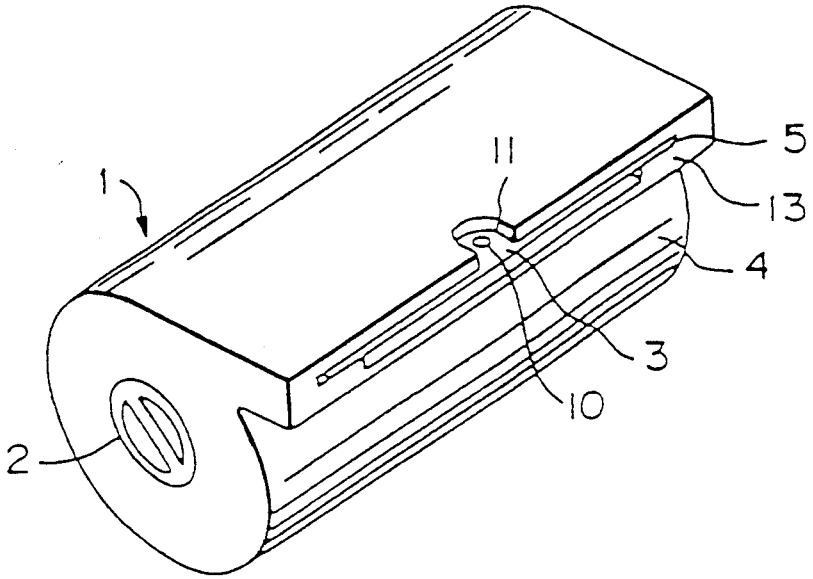
FIG. 1 is a perspective view of a photographic film cartridge of the present invention.

It is known that a magnetic recording material can be provided on a support by: (1) a method in which the support is coated with a solution containing the magnetic recording material; and (2) a method in which the magnetic recording material is dispersed or kneaded in a material constituting the support and then directly formed into a film. As to the latter method (2), depending on the material of the support, a melt extrusion method or a solution casting method is particularly well-known.

In the case of using cellulose triacetate as the dope solution, one known process involves a so-called flow extending system in which the cellulose triacetate is dissolved in a solvent such as methylene chloride and the high viscosity solution, hereinafter referred to as dope, which is obtained is extruded on a band and then dried.

As described above, when the magnetic recording layer is provided in the photograph section, it is necessary to decrease the amount of the magnetic recording material being coated per unit area. This arrangement is demanded in order to maintain the transmission density of the film at a low level. Furthermore, in order to decrease the thickness loss of magnetic output, it is necessary to make the thickness of the magnetic recording material layer as thin as possible even when the same amount of magnetic recording material is contained.

Thus, even when the flow extending system is employed, it is necessary to make the thickness of the magnetic recording layer as thin as possible. On the other hand, it is necessary for the magnetic layer to have a adequate thickness so that the layer has sufficient strength to act as a support for photographic film.

Thus, the present inventors have determined that it is necessary that a dope containing the magnetic recording material and a dope not containing the magnetic recording material should be preparedly separately, and then flow extended at the same time to form a composite structure of separate layers. The layer formed by a dope containing the magnetic recording material (in the support of the present invention) is referred to as a magnetic recording layer sometimes.

Astonishingly, however, the present inventors have discovered that when the same magnetic recording material is provided on the support at the same density and in the same thickness, the film formed by the co-flow-extending system has high orientation performance in magnetic characteristic and high magnetic output performance as compared with the film formed by the so-called coating system.

The present invention will hereinafter be explained in greater detail.

Magnetic recording materials which can be used in the present invention include ferromagnetic iron oxide fine powder, Co-containing ferromagnetic iron oxide fine powder, ferromagnetic chromium dioxide fine powder, ferromagnetic metal powder, ferromagnetic alloy powder, and barium ferrite.

Examples of ferromagnetic alloy powder are those in which the proportion of metal is at least 75 wt %, and said metal containing at least 80 wt % of at least one ferromagnetic metal or alloy (Fe, Co, Ni, Fe-Co, Fe-Ni, Co-Ni, Co-Fe-Ni, and the like) and less than 20 wt % being represented by another component (Al, Si, S, Se, Ti, V, Cr, Mn, Cu, Zn, Y, Mo, Rh, Pd, Ag, Sn, Sb, B, Ba, Ta, W, Re, Au, Hg, Pb, P, La, Ce, Pr, Nd, Te, Bi, and the like). In addition, those ferromagnetic alloy powders in which the ferromagnetic metal portion contains a small amount of water, hydroxide or oxide, can be used. These latter mentioned ferromagnetic powders can be produced by known techniques; and the ferromagnetic powder to be used in the present invention, in general, can be produced according to known methods.

Characteristics of the ferromagnetic powder are not critical in terms of size and shape; a wide range of ferromagnetic powder can be used in this regard. The shape may be any of a needle-like form, a granular form, a spherical form, a cubic form, a plate-like form, and the like. There are also no limitations to crystal size and specific surface area. The BET surface area is preferably from 2 $m^2/g$ to 65 $m^2/g$. The ferromagnetic powder is not particularly limited in pH and surface treatment employed.

For instance, the ferromagnetic powder may be subjected to surface treatment using a substance containing an element such as titanium, silicon or aluminum or an organic compound such as carboxylic acids, sulfonic acids, sulfuric acid esters, phosphoric acid ester, phosphoric acid esters, and adsorbing compounds containing a nitrogen-containing hetero-ring, e.g., benzotriazole. The pH range is preferably 5 to 10. In the case of ferromagnetic iron oxide fine powder, there are no special limitations to the ratio of two-valent iron/trivalent iron.

As the ferromagnetic powder, so-called granular Co-containing magnetite having a cubic form or an octahedral form is particularly preferred.

Materials constituting the transparent support of the present invention include semi-synthetic or synthetic polymers such as cellulose esters (e.g., cellulose triacetate, cellulose diacetate, cellulose propionate, cellulose acetate propionate, cellulose butylate, and cellulose acetate butylate), polyamide, polycarbonate, polystyrene, polysulfone, polyether sulfone, polyacrylate, and polyphenylene oxide. These polymers may be blended, if necessary depending on the balance of properties sought. Of these, cellulose esters (especially, cellulose triacetate and cellulose acetate butylate) and polycarbonate are preferred, with cellulose triacetate being particularly preferred.

In connection with the molecular weight of the polymer, those having a molecular weight of more than 10,000 can be used. In general, those having a molecular weight ranging between 20,000 and 800,000 are used in the practice of the present invention.

A plasticizer is sometimes added to the support for the purpose of imparting flexibility. In the case of cellulose ester, a plastizer such as triphenyl phosphate, biphenyldiphenyl phosphate or dimethylethyl phosphate is used.

In the support, a dye is sometimes incorporated for the purpose of e.g., making the base color neutral, preventing light piping, or preventing halation.

The solvent for use in preparation of the dope using the above polymer varies with the type of the polymer used. For example, in the case of cellulose triacetate, a mixed solvent of methylene chloride and methanol is used, and additionally a solvent such as butanol is used, if necessary. The concentration of the cellulose triacetate in the dope is 8 to 27%, and the ratio of methylene chloride to methanol is about 97/3 to 80/20. In the case of cellulose diacetate, examples of the solvents include acetone, methyl acetate, methylethyl ketone, ethyl acetate, methyl cellosolve, cellosolve acetate, nitromethane, diacetone alcohol, and a mixed solvent of methylene chloride and methanol. In the case of cellulose acetate butyrate, in addition to methylene chloride, the solvents exemplified in the case of cellulose diacetate can be used depending on the degree of substitution. In the case of polycarbonate, methylene chloride can be used.

In preparation of the dope, cellulose triacetate is dissolved in a solvent by the conventional procedure. In preparing the dope containing the magnetic recording material, a solution prepared by dispersing a magnetic substance in cellulose triacetate by the use of the usual dispersing machine such as a sand mill is then mixed.

As the co-flow-extending method, various methods as disclosed in JP-A-61-94724 (the term "JP-A" as used herein means an "unexamined published Japanese patent application") can be employed. In addition, other known co-flow-extending methods providing at least two layers can be employed. In the practice of these methods, known apparatus can be employed. To form a laminar flow by contacting the dope containing the magnetic recording material and the dope not containing the magnetic recording material, a method in which the streams are combined together at a slit output (dual lip die), or a method in which the streams are combined together at an intermediate point of the slit (composite slit die) is preferably employed. The latter method is preferred because it enables the magnetic recording layer to be thinner and provides a magnetic recording layer having an excellent magnetic performance. As the flow extending machine, any of a known band flow-extending machine, a drum flow-extending machine and the like can be employed.

Specifically, the film can be obtained by combining (meeting) and integrating the dope containing a magnetic recording material and the dope not containing a magnetic recording material in the inside of a die, i.e., prior to the slit output of the die to provide combined dopes, extruding the combined dopes out of the slit output of the die, casting the combined dopes on a band or a drum which moves relatively to a hopper, and separating the combined dopes from the band or the drum after being dried to some extent.

The polymer material for use in preparation of the above two dopes (magnetic recording material containing and nonmagnetic recording material containing) may be the same or different.

The thickness of the layer containing the magnetic recording material is preferably relatively small; the thickness is preferably not more than 6 μm and more preferably not more than 3 μm. The lower limit is 0.1 μm. The amount of the magnetic recording material contained in the layer containing the magnetic recording material is preferably 0.004 to 1 $g/m^2$ and more preferably 0.01 to 0.5 $g/m^2$. It is preferred that the increase in transmitted optical density of the support due to the presence of the magnetic recording layer is minimized. Specifically, 0.20 or less is preferable, 0.15 or less is more preferable, and 0.05 or less is most preferable, as the density through a blue filter. It is preferred that the amount of the magnetic recording material is determined taking the addition effect of the magnetic recording material on optical density of the support into account. On the other hand, the thickness of the layer not containing the magnetic recording material is 50 to 300 μm.

The magnetic recording layer may be designed so as to have all the functions of e.g., increasing lubricity, controlling curling, preventing charging, preventing adhesion or increasing scratch resistance, or another functional layer is provided thereon to impart the desired function.

The support thus obtained may be further subjected to calendering treatment to increase smoothness.

The terminology "S/N ratio" used in the present invention means a value obtained by measuring the photographic material of the present invention under the following conditions.

The head used was an input/output one of audio type having a track width of 1.4 mm and a turn number of 1000.

The conveying speed of the sample is 30 mm/sec, the input signal has a rectangular wave of 1 kHz. The measuring system noise is adjusted to enough low relatively to the sample noise. As the recorded current, the current reached the saturated level is applied. The recording density may be set in the range of 100 to 1000 bpi besides the above. The head gap is adjusted to provide the maximum output depending the density set. (The head gap is generally from 1 to 20 μm.)

The S/N ratio is required to be the minimum level required in the system. Specifically, the S/N ratio is preferably 16 dB or more, more preferably 20 dB or more, and most preferably 26 dB or more.

On the opposite surface of the magnetic recording layer of the support, after performing a typical surface treatment (e.g., chemical treatment, mechanical treatment, corona discharge treatment, high frequency wave treatment, glow discharge treatment, active plasma treatment, laser treatment, mixed acid treatment or ozone oxidation treatment), or, alternatively, without application of any surface treatment, a subbing layer is provided and then a photographic emulsion layer is provided.

Typical examples of a preferred light-sensitive material of the present invention are a color reversal film and a color negative film. The present invention will hereinafter be explained with reference to the general color negative film that can be used in the practice of the present invention.

In the light-sensitive material of the present invention, it suffices that at least one silver halide emulsion layer of a blue-sensitive emulsion layer, a green-sensitive emulsion layer and a red-sensitive emulsion layer is provided on the support. The number of silver halide emulsion layers and non-light-sensitive layers is not critical, and the order of providing the layers is also not critical. A typical example is a silver halide light-sensitive material having at least one light-sensitive layer comprising a plurality of silver halide emulsion layers which are substantially the same in color sensitivity but are different in degree of sensitivity thereto. The light-sensitive layer is a unit light-sensitive layer exhibiting sensitivity to any one of blue light, green light and red light. In a multi-layer silver halide color photographic material, the red sensitive layer, the greens sensitive layer and the blue sensitive layer are generally provided in this order from the support side. Depending on the purpose of use, an arrangement in which the above order is reversed, or an arrangement in which a different light-sensitive layer intervenes between layers sensitive to the same color, can be employed.

Between the above mentioned light-sensitive layers, and as the uppermost or lowermost layer, a light-insensitive layer such as an intermediate layer may be provided.

The intermediate layer may contain a coupler, a DIR compound, and the like as described in JP-A-61-43748, 59-113438, 59-113440, 61-20037, 61-20038, and may contain a conventional color mixing preventing agent.

A plurality of silver halide emulsion layers constituting each light-sensitive layer unit are described in West German Patent 1,121,470, or British Patent 923,045, JP-A-57-112751, 62-200350, 62-206541, 62-206543, 56-25738, 62-63936, 59-202464, and JP-B-55-34932 and 49-15495 (the term "JP-B-" as used herein means an "examined published Japanese patent application").

Silver halide particles may be those having a regular crystal form, such as cubic, octahedral or tetradecahedral, or those having an irregular crystal form, such as spherical or plate-like, or those having a crystal defect, such as twin crystal, or those having a composite form thereof.

Silver halide particles are not particularly in size for the present invention and may be either fine particles having a particle diameter of less than about 0.2 micron or large sized particles having a projected surface area diameter of about 10 microns. Either a multi dispersion emulsion or a single dispersion emulsion can be used.

Silver halide photographic emulsion which can be used in the present invention can be prepared by methods described in, for example, Research Disclosure (RD), No. 17643 (December 1978), pp. 22 to 23, "I. Emulsion Preparation and Types" and ibid., No. 18716 (November 1979), p. 648, P. Glafkides, Chemie et Phisique Photographique, Paul Montel, 1967, G. F. Duffin, Photographic Emulsion Chemistry, Forcal Press, 1966, and V. L. Zeilikman et al., Making and Coating Photographic Emuslion, Focal Press, 1964.

Preferred single dispersion emulsions as described in, for example, U.S. Pat. Nos. 3,574,628, 3,655,394 and British Patent 1,413,748 are used.

Plate-like particles having an aspect ratio of at least about 5 can be used in the present invention. Such plate-like particles can be easily prepared by methods described in Gutoff, Photographic Science and Engineering, Vol. 14, pp. 248 to 257 (1970), U.S. Pat. Nos. 4,434,226, 4,414,30, 4,433,048, 4,439,520, and British Patent 2,112,157.

The crystal structure may be uniform, or may be composed of a halogen composition which is different between the inside and the outer portion, or may be laminar or may be such that a silver halide having a different composition is bonded thereto by epitaxial bonding, or may be bonded to a compound other than silver halide, such as silver thiocyanide or lead oxide.

In addition, a mixture of particles having various crystal forms can be used.

The silver halide emulsion is usually subjected to physical ripening, chemical ripening and spectral sensitization. The efficiency of the present invention is exhibited particularly significantly when an emulsion sensitized with a gold compound and a sulfur-containing compound is employed. Additives used at the ripening or sensitization step are described in Research Disclosure, Nos. 17643 and 18716, and the corresponding pages are shown in the list shown below.

Known photographic additives which can be used in the present invention are also described in the above two Research Disclosures Nos. 17643 and 18716; the corresponding pages are shown in the list shown below.

| Additive | RD 17643 | RD 18716 |
|---|---|---|
| 1. Chemical Sensitizer | p. 23 | p. 648, right column |
| 2. Sensitivity Increasing Agent | | p. 648, right column |
| 3. Spectral Sensitizer | pp. 23–24 | p. 648, right column to |
| Super Color Sensitizer | | p. 649, right column |
| 4. Brightening Agent | p. 24 | |
| 5. Anti-foggant and Stabilizer | pp. 24–25 | p. 649, right column |
| 6. Light Absorber, Filter Dye, and Ultraviolet Absorber | pp. 25–26 | p. 649, right column to p. 650 left column |
| 7. Stain Inhibitor | p. 25, right column | p. 650, left column to right column |
| 8. Dye Image Stabilizer | p. 25 | |
| 9. Hardner | p. 26 | p. 651, left column |
| 10. Binder | p. 26 | p. 651, left column |
| 11. Plastcizer, Lubricant | p. 27 | p. 650, right column |
| 12. Coating Aid, Surfactant | pp. 26–27 | p. 650, right column |

In order to prevent deterioration of photographic performance due to formaldehyde gas, it is preferred that a compound capable of reacting with formaldehyde, thereby fixing it, as described in U.S. Pat. Nos. 4,411,987 and 4,435,503, be incorporated in the light-sensitive material.

In the present invention, various color couplers can be used. Representative examples are described in the patents listed in the aforementioned Research Disclosure (RD) No. 17643, section VII-C to G therein.

As yellow couplers, those described in, for example, U.S. Pat. Nos. 3,933,501, 4,022,620, 4,326,024, 4,401,752, 4,248,961, JP-B-58-10739, British Patent 1,425,020, 1,476,760, U.S. Pat. Nos. 3,973,968, 4,314,023, 4,511,649, and European Patent 249,473A are preferably used.

As magenta couplers, 5-pyrazolone- and pyrazoloazole-based compounds are preferred. Particularly preferred are compounds described in, for example, U.S. Pat. Nos. 4,310,619, and 4,351,897, European Patent 73,636, U.S. Pat. Nos. 3,061,432 and 3,725,067, Research Disclosure No. 24220 (June 1984), JP-A-60-33552, Research Disclosure No. 24230 (June 1984), JP-A-60-43659, 61-72238, 60-35730, 55-118034, 60-185951, U.S. Pat. Nos. 4,500,630, 4,540,654 and 4,556,630, and WO(PCT) 88/04795.

Cyan couplers include phenol- and naphthol-based couplers. Preferred are compounds described in, for example, U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Laid-Open No. 3,329,729, European Patents 121,365A and 249,453A, U.S. Pat. Nos. 3,446,622, 4,333,999, 4,753,871, 4,451,559, 4,427,767, 4,690,889, 4,254,212 and 4,296,199, and JP-A-61-42658.

As colored couplers for use in correction of unnecessary absorption of colored dye, compounds described in, for example, Research Disclosure No. 17643, Clause VII-G, U.S. Pat. No. 4,163,670, JP-B-57-39413, U.S. Pat. Nos. 4,004,929 and 4,138,258, and British Patent 1,146,368 are preferred.

As couplers in which colored dye possesses excessive diffusability, compounds described in, for example, U.S. Pat. No. 4,366,237, British Patent 2,125,570, European Patent 96,570, and West German (Laid-Open) No. 3,234,533 are preferred.

Typical examples of polymerized dye-forming couplers are described in, for example, U.S. Pat. Nos. 3,451,820, 4,080,211, 4,367,282, 4,409,320 and 4,576,910, and British Patent 2,102,137.

Couplers releasing a photographically useful group upon coupling are preferably used in the present invention. As DIR couplers releasing a development inhibitor, compounds described in, for example, the patents listed in the aforementioned RD No. 17643, Clause VII to F, JP-A-57-151944, 57-154234, 60-184248 and 63-37346, and U.S. Pat. No. 4,248,962 are preferred.

As couplers releasing imagewise a nuclease-making agent or development accelerator at the time of development, compounds described in, for example, British Patent 2,097,140, 2,131,188, JP-A-59-157638, and 59-170840 are preferably used.

In addition, competitive couplers described in U.S. Pat. No. 4,130,427, multi-equivalent couplers described in U.S. Pat. Nos. 4,283,472, 4,338,393, and 4,310,618, DIR redox compound-releasing couplers, DIR coupler-releasing couplers, DIR coupler-releasing redox compounds or DIR redox-releasing redox compounds described in, for example JP-A-60-185950 and 62-24252, a coupler compound releasing a coupler which recovers the original color after releasing, as described in European Patent 173,302A, couplers releasing a bleach accelerator as described in, for example, RD No. 11449, ibid., 24241, and JP-A-61-201247, couplers releasing a ligand as described in, for example U.S. Pat. No. 4,553,477, couplers releasing a leuco dye as described in JP-A-63-75747, can be used in the light-sensitive material of the present invention.

Couplers to be used in the present invention can be incorporated into the light-sensitive material by various known dispersing methods.

Examples of high boiling solvents to be used in an oil-in-water dispersing method are described in, for example, U.S. Pat. No. 2,322,027.

Representative examples of high boiling organic solvents having a boiling point of at least 175° C. under atmospheric pressure, which are to be used in the oil-in-water dispersing method include phthalic acid esters, phosphoric acid or phosphoric acid esters, benzoic acid esters, amides, alcohols or phenols, aliphatic carboxylic acid esters, aniline derivatives, and hydrocarbons. As auxiliary solvents, organic solvents having a boiling point of at least about 30° C., preferably 50° to about 160° C. can be used. Typical examples are ethyl acetate, butyl acetate, ethyl propinate, methyl ethyl ketone, cyclohexanone, 2-thoxyethyl acetate, and dimethylformamide.

Steps and effects of the latex dispersing method, and representative examples of latexes for impregnation are described in, for example, U.S. Pat. No. 4,199,363, West German Patent Application (OLS) Nos. 2,541,274 and 2,541,230.

The total film thickness of all hydrophilic colloid layers on the side of the present light-sensitive material on which emulsion layers have been provided, is preferably not more than 28 μm, and the film swelling speed $T_{\frac{1}{2}}$ is preferably not more than 30 seconds. The film thickness refers to one which is measured under conditions of 25° C. and 55% RH (2 days), and the film swelling speed $T_{\frac{1}{2}}$ can be measured according to techniques known in the field, such as, by the use of a swellometer of the type described in A. Green et al., Photogr. Sci. Eng., Vol. 19, No. 2, pp. 124–129. $T_{\frac{1}{2}}$ is defined as a time required until, assuming that 90% of the maximum swollen film thickness attained when the film is treated with a color developer at 30° C. for 3.25 minutes, is a saturated film thickness, the film thickness reaches ½ of the saturated film thickness.

The film swelling speed $T_{\frac{1}{2}}$ can be controlled by adding a hardner to gelatin as a binder, or changing aging conditions after coating. The swelling ratio is preferably 150 to 400%. The swelling ratio can be calculated from an equation: (maximum swollen film thickness—film thickness)/film thickness and wherein the maximum swollen film thickness is the same as defined above.

The color light-sensitive material prepared according to the present invention is developed by typical developing methods such as described in the aforementioned RD No. 17643, pp. 28–29 and ibid. No. 18716, p. 615, left column to right column.

The color light-sensitive material of the present invention may contain therein a color developing agent for the purpose of e.g., simplification of treatment, or acceleration of treatment. In this case, various color developing agent precursors are preferred to use. These precursors include indoaniline-based compounds described in U.S. Pat. No. 3,342,597, Shift base type compounds described in U.S. Pat. No. 3,342,599, Research Disclosure Nos. 14,850, 15,159 and 13,924.

The light-sensitive material of the present invention is preferably in the form of a roll-like film which allows input of signals with ease in the transparent magnetic recording layer at the time of conveying it in a camera or a printer. In this roll-like film, it is preferred that the area of a frame in image exposing areas be 350 to 1,200 $mm^2$, and the magnetic informing recordable space be at least 15% of the surface area of one frame in the image exposing areas. More specifically, it is preferred that the number of perforations per one frame be made less than 135 formats. It is particularly preferred that the number of perforations per one frame be not more than 4.

In the magnetic information recordable space, information can be inputted optically by the use of a light emitter such as LED. It is also preferred that magnetic information and optical information be input in the space in a superposed manner. The magnetic recording format is preferably according to the system described in WO 90/04205.

If the light-sensitive material of the present invention is used in the form of roll, it is housed preferably in a cartridge. The most commonly used cartridge is the existing 135 format patrone. In addition, there can be used cartridges as proposed in JP-A-U-58-67329 and 58-195236 (the term "JP-A-U" as used herein means an "unexamined published Japanese utility model application"), in JP-A-58-181035 and 58-182634, in U.S. Pat. Nos. 4,221,479, 4,846,418, 4,848,693 and 4,832,275, in Japanese Patent Application Nos. 63-183344 and 1-21862, and in JP-A-1-231045, 2-170156, 2-205843, 2-210346, 2-199451, 2-201441, 2-214853, 2-211443, 2-264248, 3-37646, 3-37645 and 2-124564. Particularly preferred is a cartridge having means to control its position in the camera, as described in Japanese Patent Application No. 1-214895.

The cartridge used in the present invention is made mainly of synthetic plastics.

In molding such plastic articles of the present invention, a plasticizer is mixed therewith, if necessary. Typical examples of the plasticizer are trioctyl phosphate, tributyl phosphate, dibutyl phthalate, diethyl sebacate, methyl amyl ketone, nitrobenzene, γ-valerolactone, di-n-octyl succinate, bromo-naphthalene, butylpalminate, and the like.

Representative examples of plastic materials to be used in the present invention are shown below, although the present invention is not limited thereto.

Polystyrene, polyethylene, polypropylene, poly(monochlorotrifluoroethylene), a vinylidene chloride resin, a vinyl chloride resin, a vinyl chloride-vinyl acetate copolymer resin, an acrylonitrile-butadiene-styrene copolymer resin, a methyl methacrylate resin, a vinyl formal resin, a vinyl butyral resin, polyethylene terephthalete, Teflon, Nylon, a phenol resin, a melamine resin, and the like.

Plastic materials which are particularly preferably used in the present invention include polystyrene, polyethylene, polypropylene, and the like.

In addition, the cartridge of the present invention may contain therein various antistatic agents. Although the antistatic agent is not critical, carbon black, metal oxide particles of the present invention, nonionic, anionic, cationic and betaine-based surfactants, nonionic, anionic, cationic and betaine polymers, and the like are preferably used. These cartridges rendered antistatic are described in, for example, JP-A-1-312537 and 1-312538.

The cartridge is usually produced using a plastic material in which carbon black or pigment, for example, has been incorporated for the purpose of light shielding.

Although the cartridge may be of the current marketed size, it is effective for miniaturization of camera to make the present cartridge diameter, no greater than about 25 mm, preferably 22 mm or less, and more preferably 20 mm or less but about 14 mm or more. In the case of the present cartridge, the top end of a spool at the side where the cartridge is connected to the film driving part of the camera, is projected, making a hindrance for miniaturization of the camera and, therefore, it is preferred that the projection be removed. This results in a reduction in volume of the cartridge, the present volume being about 35 $cm^3$. The volume of the cartridge is preferably not more than 30 $cm^3$, more preferably not more than 25 $cm^3$, and most preferably not more than 20 $cm^3$. The weight of the plastic material used in the cartridge or cartridge case is 1 to 25 g and preferably 5 to 15 g.

The ratio of the inner volume of the cartridge case and weight of the plastics used for the cartridge and the cartridge case is from 4 to 0.7 and preferably from 3 to 1.

In the case of the cartridge containing a 135 color light-sensitive material according to the present invention, the total weight of the plastics used in the cartridge and the cartridge case is usually from 1 to 25 g, and preferably from 5 to 15 g.

The shape of the cartridge containing the color light-sensitive material of the present invention will hereinafter be explained.

The shape of the cartridge of the present invention is not particularly limited, but it is preferred that the shape be suitable for use in cameras currently on the market. However, other types of cameras which can accommodate a cartridge containing the color light-sensitive material of the present invention may also be used.

Figure 2:
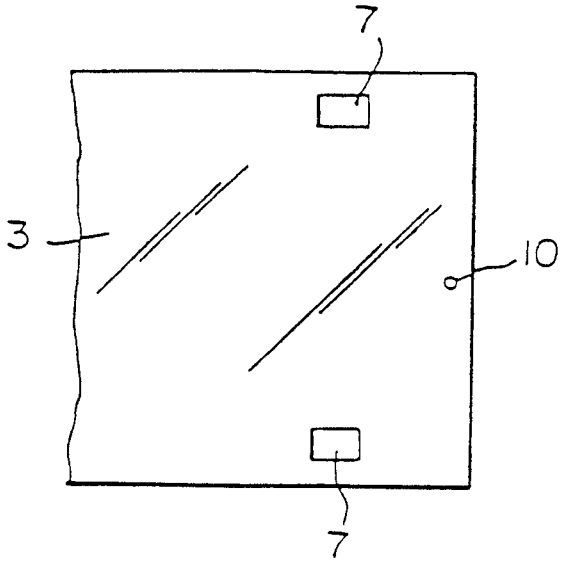
FIG. 2 is a top plan view illustrating the state of a top end portion of a photographic film.
Figure 3:
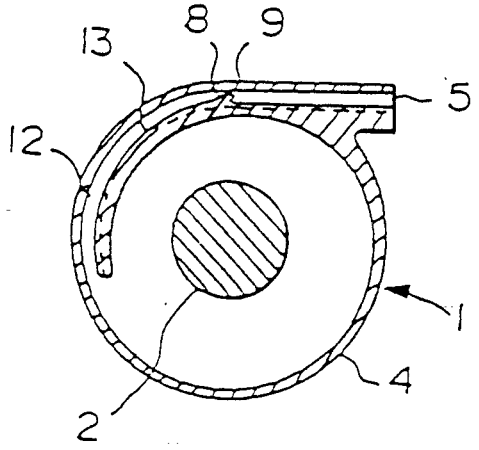
FIG. 3 is a cross-sectional view of the cartridge of FIG. 1.
Figure 4:
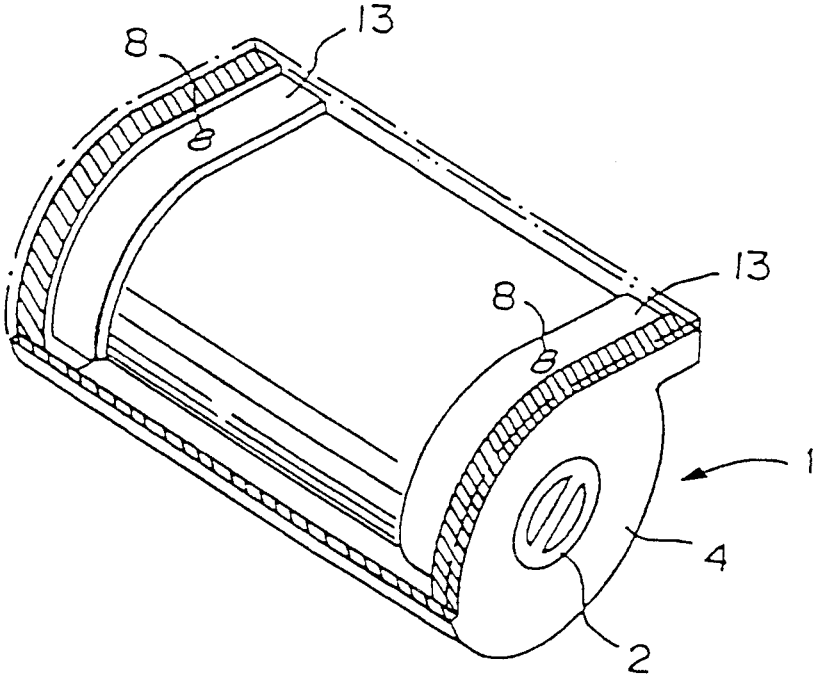
FIG. 4 is a partially broken view illustrating the inside of the cartridge of FIG. 1.

A specific example of the cartridge of the invention is shown in FIG. 1. Interior structures of the cartridge are shown in FIGS. 2 to 4.

As shown in FIG. 1, the cartridge 1 has a generally cylindrical main body portion 4 in which is rotatably mounted a spool 2 on which the film 3 is wound. The cartridge 1 has an integrally formed mouth portion 5 extending tangentially from the side of the main body portion 4. The mouth portion 5 defines an exit slit through which the film 3 is pulled out from the cartridge. As depicted in FIG. 2, the leading end of the film 3 has a hole 10 formed at the center thereof which aligns with a cutout 11 in the mouth portion 5 of the cartridge 1. The film 3 has perforation 7 formed along its edge. As shown in FIG. 3 and 4, rail-like guides 13 are provided along the sides of the interior of the mouth portion 5. Protrusions 8 having a peak part 9, formed on the guides 13, protrude in the direction of movement of the film as the film is pulled out of the cartridge 1, through the film passageway 12.

In the present invention if a transparent magnetic recording layer is provided on the support of the present invention which has been produced by co-flow-extending, a silver halide photographic material can be obtained which exhibits maximum magnetic characteristics, using as small a coverage of magnetic recording material as possible so as not to deteriorate photographic properties.

The present invention is described in greater detail with reference to the following nonlimiting examples.

EXAMPLE 1

Co-doped γ-ferric oxide (needle-like particles, specific surface area: 38 $m^2/g$, coercive force: 810 Oe) was dispersed in cellulose triacetate by the use of a sand mill. The dispersion thus obtained was used to prepare a dope (A). Separately, a dope (B) was prepared. The dopes (A) and (B) were co-flow-extended on an extended band by the use of a composite slit die in such a manner that the dry films of the dopes (A) and (B) were, respectively, 3 μm and 110 μm in thickness, and further that the film of the dope (A) was an upper layer.

| | Dope (A) | Dope (B) |
|---|---|---|
| Cellulose triacetate | 10.0 parts | 23.0 parts |
| Triphenyl phosphate | 1.0 | 2.3 |
| Biphenyldiphenyl phosphate | 0.6 | 1.3 |
| Co-γ-ferric oxide | 0.33 | — |
| Methylene chloride | 79.5 | 65.7 |
| Methanol | 3.5 | 2.9 |
| n-Butanol | 5.8 | 4.8 |

In a comparative example, the dope (B) was used to form a film having a thickness of 110μ separate from a magnetic recording material containing dope. On this film as the base, a coating solution (C), as shown below, was coated by the use of a dip coater in a dry film thickness of 5μ to produce a comparative support having separately formed layers.

| | (C) |
|---|---|
| Cellulose triacetate | 2.0 parts |
| Triphenyl phosphate | 0.2 |
| Biphenyldiphenyl phosphate | 0.12 |
| Co-γ-ferric oxide | 0.03 |
| Methylene chloride | 87.4 |
| Methanol | 3.8 |
| n-Butanol | 6.4 |

On the surface opposite to the magnetic recording layer in the above samples, after a conventional subbing treatment, was coated a color negative photographic emulsion layer of the same formulation as in Sample 101 as described in the examples of JP-A-2-44345.

Each sample thus obtained was subjected to light exposure for sensitometry (4,800K, 1/100 second, 2 CMS) and then developed by the same method as in Example 1 of JP-A-2-854. Each sample thus treated was subjected to sensitometry by the use of each of B, G and R filters, and the sensitivity through the B filter was obtained as a relative value.

On the other hand, each sample was measured for square ratio by the use of a Vibrating Sample-type Magnetometer (VSM) (produced by Touei Kogyo K.K). After each sample was slitted into 35 mm width, rectangular wave signals were recorded and reproduced on each slitted sample at a convey speed of 30 mm/seconds by contacting each magnetic recording layer with an input/output head having a turn number of 1000 and a head gap of 5 μm. Thus, a magnetic input or output test was conducted and whether or not the input signal was correctly reproduced was checked. For each sample, the test was conducted 500 times, and the proportion wherein output errors occurred, was determined. The results are shown in Table 1 hereinafter.

Samples were produced in which the thickness of the magnetic recording layer and the content of the magnetic recording material were changed as indicated in Table 1 below, and which were produced by co-flow-extending or, alternatively, as a separate coating from the nonmagnetic recording material containing layer. After coating of photographic emulsions in the same manner as above, the samples were evaluated.

It can be seen from Table 1 below that when the magnetic recording layer is provided by co-flow-extending according to the present invention, the square ratio is increased as compared with that when the magnetic recording layer is provided by separate coating, and, accordingly, the magnetic output performance is increased in the present invention. If the content of the magnetic recording material is too small, the magnetic output performance is decreased, while if the content is too large, photographic sensitivity is decreased. It can be further seen that even when the content of the magnetic recording material is held the same, if the thickness of the layer containing the magnetic recording material is increased excessively, magnetic output is not satisfactory.

TABLE 1

| No. | Magnetic Recording Material: Cobalt-γ-Ferric Oxide: Forming Method | Content ($g/m^2$) | Layer Thickness (μm) | Square Ratio | Magnetic Output Error Proportion % | Relative Photographic Sensitivity | Remarks |
|---|---|---|---|---|---|---|---|
| 1a | Co-flow-extending | 0.1 | 3 | 0.80 | 0 | 100 | Invention |
| 1b | Coating | 0.1 | 3 | 0.55 | 30.5 | 100 | Comparison |
| 2a | Co-flow-extending | 0.004 | 3 | 0.80 | 0.01 | 102 | Invention |
| 2b | Coating | 0.004 | 3 | 0.54 | 45.2 | 102 | Comparison |
| 3a | Co-flow-extending | 0.001 | 3 | 0.70 | 45.8 | 102 | Comparison |
| 3b | Coating | 0.001 | 3 | 0.53 | 52.3 | 102 | Comparison |
| 4 | Co-flow-extending | 1.0 | 3 | 0.81 | 0 | 97 | Invention |
| 5 | Co-flow-extending | 1.5 | 3 | 0.80 | 0 | 65 | Comparison |
| 6 | Co-flow-extending | 0.1 | 6 | 0.77 | 0 | 100 | Invention |
| 7 | Co-flow-extending | 0.1 | 10 | 0.62 | 18.4 | 100 | Comparison |

EXAMPLE 2

The same test as in Example 1 was conducted using Fe metal magnetic substance (needle-like particles, specific surface area 35 $m^2/g$, Hc=920 Oe) as the magnetic recording material. Similar results to those of Example 1 were obtained.

EXAMPLE 3

The same test as in Example 1 was conducted using polycarbonate in place of cellulose triacetate. That is, the procedure of Example 1 was repeated in which the dope (A) containing the magnetic recording material, the dope (B) not containing the magnetic recording material, and the coating solution(C) of the formulations shown below were used.

| | (A) | (B) | (C) |
|---|---|---|---|
| Polycarbonate (M.W. 100,000) | 9.0 parts | 17.0 parts | 2.0 parts |
| Co-γ-Ferric oxide | 2.7 | — | 0.03 |
| Methylene chloride | 91.0 | 83.0 | 97.97 |

Similar results to those of Example 1 were obtained.

EXAMPLE 4

Supports each having a magnetic layer were prepared according to the combinations indicated in Table 2, in the same manner as in Example 1 except that cubic Co-containing magnetite (having a specific surface area of 5 $m^2/g$ and a coercive force of 810 Oe) and the metal magnetic substance used in Example 2 were used besides Co-doped γ-ferric oxide, and a dual slip die (i.e., a method where dopes are met at the slit output) was applied as a co-flow-extending method besides a composite slit die. The thickness of each magnetic recording layer was set to 2 μm and each amount of the magnetic recording material was adjusted such that the transmitted density through a B filter (a blue filter) measured using X-RITE STATUS A (produced by X-RITE CO., LTD.) was 0.05. Each sample was slitted into 35 mm width and rectangular wave signals having 1 kHz were recorded and reproduced on the above-slitted samples at a conveying speed of 35 mm/sec using an input/output head having a head gap of 7 μm, a track width of 1.4 mm and a turn number of 1000 to obtain S/N ratios. The obtained results are shown in Table 2.

TABLE 2

| No. | Magnetic Recording Material* | Method** | S/N ratio (dB) | Remarks |
|---|---|---|---|---|
| 21 | A | 1 | 14.2 | Comparison |
| 22 | B | 1 | 15.1 | " |
| 23 | C | 1 | 14.4 | " |
| 24 | A | 2 | 17.1 | Invention |
| 25 | B | 2 | 19.0 | " |
| 26 | C | 2 | 17.5 | " |
| 27 | A | 3 | 18.6 | " |
| 28 | B | 3 | 21.3 | " |
| 29 | C | 3 | 18.9 | " |

*Magnetic recording material
A: needle Co-doped γ-ferric oxide
B: cubic Co-containing magnetite
C: metal
**Method of providing each magnetic recording layer
1: coating
2: an edge meeting type of co-flow-extending
3: an inside meeting type of co-flow-extending It can be seen also from the results of Examle 4, as seen from those of Example 1, that the magnetic recording layers provided by the co-flow-extending methods provided higher S/N ratios than those provided by the coating method and in comparison between the magnetic recording layers provided by the co-flow-extending methods, those provided by the inside meeting type of co-flow-extending method provided higher S/N ratios than those provided by the edge meeting type of co-flow-extending method. In addition, it can be seen that the magnetic recording layers containing the cubic Co-containing magnetite provided higher S/N ratios than those containing Co-doped γ-ferric oxide, and in comparison between the magnetic recording layers containing the cubic Co-containing magnetite, those provided by the inside meeting type of co-flow-extending method provided higher S/N ratios than those provided by the edge meeting type of co-flow-extending method.

EXAMPLE 5

The same test as in Example 4 was conducted except that polycarbonate was used in place of cellulose triacetate and dopes were prepared in the same manner as in Example 3. The obtained results were similar to those of Example 4.

While the invention has been described in detail and with reference to specific examples thereof, it will be apparent to one skilled in the art that various changes and modifications can be made therein without departing from the spirit and scope thereof.

What is claimed is:

1. A silver halide photographic material comprising a transparent support containing a magnetic recording material, wherein the material constituting the transparent support is selected from the group consisting of polycarbonate and cellulose ester, and the transparent support is formed by co-flow-extending a first dope containing magnetic recording material and a second dope not containing magnetic recording material.

2. The material as claimed in claim 1, wherein the content of the magnetic recording material in said first dope is 0.004 to 1.0 g per square meter.

3. The material as claimed in claim 1, wherein the thickness of the layer formed from said first dope containing the magnetic recording material is not more than 6 μm.

4. The material as claimed in claim 1, wherein the material constituting the support is cellulose triacetate.

5. The material as claimed in claim 1, wherein the material constituting the support is cellulose acetate butyrate.

6. The material as claimed in claim 1, wherein the thickness of the layer formed from said second dope not containing the magnetic recording material is 50 to 300 μm.

7. The material as claimed in claim 1, wherein the magnetic recording material is a granular Co-containing magnetite.

8. The material as claimed in claim 1, wherein the co-flow-extending comprises the steps of contacting the first dope containing a magnetic recording material and the second dope not containing a magnetic recording material in the inside of a die to provide contacted dopes, extruding the contacted dopes out of a slit of the die, casting the contacted dopes on a band or a drum and separating the contacted dopes from the band or the drum.

9. The material as claimed in claim 1, wherein the increase in transmitted density of the support measured through a blue filter due to the presence of the magnetic recording layer is 0.2 or less.

10. The material as claimed in claim 1, wherein the S/N ratio of the magnetic output of the material is 16 dB or more.

* * * * *